United States Patent [19]

Tarutani et al.

[11] Patent Number: 4,770,703

[45] Date of Patent: Sep. 13, 1988

[54] SINTERED STAINLESS STEEL AND PRODUCTION PROCESS THEREFOR

[75] Inventors: Yoshio Tarutani; Takeo Kudo, both of Nishinomiya; Akira Seki, Minoo; Masaru Nishiguchi, Ashiya, all of Japan

[73] Assignee: Sumitomo Metal Industries, Ltd., Osaka, Japan

[21] Appl. No.: 741,185

[22] Filed: Jun. 4, 1985

[30] Foreign Application Priority Data

Jun. 6, 1984 [JP] Japan ..... 59-114427
Jun. 6, 1984 [JP] Japan ..... 59-114428

[51] Int. Cl.[4] ..... C22C 19/05; C22C 29/16; C22C 38/08

[52] U.S. Cl. ..... 75/246; 75/244

[58] Field of Search ..... 75/246, 126 C, 126 S, 75/128 N, 128 W, 244

[56] References Cited

U.S. PATENT DOCUMENTS 3,940,269 2/1976 Bergstrom .
3,980,444 9/1976 Reen ..... 75/244
4,032,336 6/1977 Reen ..... 419/47
4,302,247 11/1981 Abe et al. ..... 148/442
4,435,483 3/1984 Ahslund et al. ..... 428/566
4,581,202 4/1986 Kudo et al. ..... 419/42

FOREIGN PATENT DOCUMENTS 56-102549 8/1981 Japan ..... 75/246
6013051 1/1985 Japan ..... 75/246
2080331 2/1982 United Kingdom ..... 75/128 W
2160221 12/1985 United Kingdom ..... 75/128 W

OTHER PUBLICATIONS

Speich, "Metals Handbook", vol. 8, 8th Ed, pp. 424–426, 1973.

*Primary Examiner*—John F. Terapane
*Assistant Examiner*—Eric Jorgensen
*Attorney, Agent, or Firm*—Burns, Doane, Swecker & Mathis

[57] ABSTRACT

A sintered stainless steel exhibiting improved resistance to stress corrosion cracking which comprises a matrix phase and a dispersed phase and a process for manufacturing same are disclosed. The dispersed phase is of an austenitic metallurgical structure and is dispersed throughout the matrix phase which is comprised of an austenitic metallurgical structure having a steel composition different from that of the dispersed phase or a ferrite-austenite duplex stainless steel.

6 Claims, 6 Drawing Sheets

$$\sigma = E t y \left\{ \frac{2}{3}\ell_1^2 + \ell_1 \ell_2 + \frac{1}{4}\ell_2^2 \right\}^{-1}$$

E: YOUNG'S MODULUS

SINTERED STAINLESS STEEL AND PRODUCTION PROCESS THEREFOR

BACKGROUND OF THE INVENTION

The present invention relates to a sintered stainless steel exhibiting markedly improved resistance to stress corrosion cracking and a process for the production thereof, the steel comprising a matrix phase of an austenitic or ferritic-austenitic duplex structure and a dispersed phase of an austenitic structure.

In particular, the present invention relates to a sintered stainless steel which exhibits markedly improved resistance to stress corrosion cracking under a $CO_2$-$H_2S$-chloride ion-containing environment (referred to hereunder as "$Co_2$-$H_2S$-$Cl^-$ environment").

In recent years, gas and oil wells have been exploited deep under ground under increasingly severe conditions. The depths of gas and oil wells sometimes reach 10,000 meters below the ground. Seamless steel tubes used in assemblying oil and gas wells, i.e., drilling pipes, and tubing and casing pipes (hereinafter collectively referred to as "oil well tubing and casing pipes") are used under much more severe corrosive and mechanical conditions. Newly developed oil and gas wells are in general characterized in that the oil is sweet and sour, and the temperature and pressure are also increasing. Namely, the oil well tubing and casing pipes are used in an environment containing a large amount of $CO_2$ gas, $H_2S$ gas, and concentrated $Cl^-$ ions at a high temperature and pressure.

Under those severe conditions, in place of a conventional low Cr steel, a martensitic 13Cr steel has widely been used. However, even such 13Cr steel is not free from general corrosion and pitting corrosion under the severe conditions in a deep well. In case of a strengthened steel, sulfide stress corrosion cracking easily occurs in the presence of a minor amount of $H_2S$.

Thus, in oil and gas wells in which the concentration of $H_2S$ gas is relatively high, even 13Cr steel does not exhibit satisfactory resistance to corrosion. Therefore, in the past few years in place of 13Cr steel, a ferrite-austenite duplex stainless steel which contains 22–25% of Cr has been used.

Duplex stainless steel is a stainless steel which contains two types of phases and exhibits a threshold stress higher than that of austenitic or ferritic stainless steel which contains Cr at the same level. Furthermore, duplex stainless steel is satisfactory in respect to its resistance to SCC, tensile strength, and toughness.

As is well known in the art, duplex stainless steel is characterized by a high threshold stress value against SCC. FIG. 1 shows graphs disclosed in the Journal of Corrosion Engineering, vol. 30, No. 4, pp. 218–226 (1981) by one of the inventors of the present invention.

FIG. 1 shows graphs of the SCC resistance determined for 25Cr-6Ni duplex stainless steel (designated by the symbol "O"), 28Cr-4Ni ferritic stainless steel, the composition of which corresponds to that of the ferritic phase of the duplex steel (designated by the symbol "•"), and 21Cr-9Ni austenitic stainless steel, the composition of which corresponds to that of the austenitic phase of the duplex steel (designated by the symbol "Δ"). After preparing these three types of steel through an ingot making process, corrosion tests were carried out using a 427K, 45% $MgCl_2$ solution. Graph (a) shows the relationship between the applied stress and the time to failure. Graph (b) shows the stress ratio, i.e. the ratio of the threshold stress against SCC to the 0.2% yielding point ($\sigma_{th}/\sigma_{0.2}$) plotted with respect to the time to failure. The higher the ratio, the better is the SCC resistance.

As is apparent therefrom, 25Cr-6Ni duplex stainless steel (designated by "O") exhibits a $\sigma_{th}/\sigma_{0.2}$ ratio higher than those of 21Cr-9Ni steel (designated by "Δ") and 28Cr-4Ni steel (designated by "•") at a time to failure of 600 hours or longer. This means that the resistance to SCC of the duplex stainless steel is much better than that of the austenitic or ferritic stainless steel.

Fontana et al. first reported concerning why duplex stainless steel can exhibit such improved resistance to SCC as described above and said that due to its chemical composition the ferrite phase causes a keying effect by which duplex stainless steel can exhibit such improved properties. Uhlig et al and Shimodaira et al also reported their investigations on the mechanism of such a keying effect.

Furthermore, one of the inventors of the present invention disclosed in the previously mentioned paper that the resistance to SCC of duplex steel does not depend on the chemical composition of each of the constituent phases, i.e., matrix phase and dispersed phase, but on the structure in which the two phases are present in a mixed state. That is, the resistance to SCC is derived from a keying effect caused by the presence of an austenitic phase dispersed in a discrete state in a matrix phase.

FIG. 2 schematically illustrates the above-described mechanism of SCC propagation in a conventional duplex stainless steel, which was prepared using an ingot making process. In this figure, the thick line indicates the path along which the SCC propagates. It is apparent that the SCC resistance of a duplex stainless steel is first determined by that of the ferritic phase contained therein. Therefore, if the ferritic phase exhibit improved SCC resistance, the duplex steel can exhibit improved SCC resistance. If not, as shown in FIG. 2, the SCC propagates through a ferritic phase, detours a discrete phase, and stops upon reaching another austenitic phase in conventional duplex stainless steels.

FIG. 3 is a graph which one of the inventors of the present invention disclosed in "Journal of Materials for Energy Systems", Vol. 5, No.1, June 1983, pp. 59–66. The graph summarizes test results of the SCC resistance of a ferrite-austenite duplex stainless steel in a $CO_2$-$H_2S$-$Cl^-$ environment. Typical, commercially available duplex stainless steel includes 22Cr series (22Cr-5.5Ni-3Mo) and 25Cr series (25Cr-7Ni-3Mo) steels. The graph shown in FIG. 3 was obtained by carrying out a corrosion test using 25Cr series steels in a 25% NaCl solution containing $CO_2$ at 30 atms with varying temperature and $P_{H2S}$. In this figure, the symbols "•" and " ◑ indicate cases in which SCC occurred. As is apparent from FIG. 3, for practical purposes the upper limit of $P_{H2S}$ is 0.1 atm. It was observed that a preferential attack took place on the ferritic phase and the SCC originated from the area where the preferential attack occurred.

Needless to say, in order to further improve the resistance to corrosion it is easily anticipated by those skilled in the art to increase the Cr content of the duplex steel. However, the higher the Cr content, the more easily $\sigma$ (sigma) phase forms, making the working thereof practically impossible.

Thus, at present, an application in which the use of the duplex stainless steel might cause troubles in respect to the resistance to corrosion has required the employment of Hastelloy C276 (tradename: 15Cr-16Mo-3.4W-1.0Co-60Ni-Bal. Fe), MP 35N (tradename: 20Cr-10Mo-35Co-35Ni-Bal. Fe), etc. However, these alloys are quite expensive, since they contain a relatively large amount of expensive alloying elements such as Mo, Co, and Ni. In addition, their hot workability and productivity are not satisfactory, since they contain a relatively large amount of these alloying elements.

OBJECTS OF THE INVENTION

The primary object of the present invention is to provide a stainless steel exhibiting much better resistance to SCC in a $CO_2$-$H_2S$-$Cl^-$ environment than that of conventional ferrite-austenite duplex stainless steels.

A secondary object of the present invention is to provide an austenitic stainless steel with a high content of Ni, which exhibits markedly improved resistance to SCC in a $CO_2$-$H_2S$-$Cl^-$ environment.

Another object of the present invention is to provide a duplex stainless steel exhibiting markedly improved resistance to SCC in a $CO_2$-$H_2S$-$Cl^-$ environment, which may be used in place of a conventional austenitic stainless steel with a high content of Ni.

Still another object of the present invention is to provide an austenitic or ferrite-austenite duplex stainless steel which is less expensive but exhibits markedly improved resistance against SCC in a severe $CO_2$-$H_2S$-$Cl^-$ environment in which only an expensive high alloy steel containing expensive alloying elements such as Mo, W, and Ni has been thought usable.

A further object of the present invention is to provide a process for manufacturing a high alloy product containing a relatively large amount of Mo, W, and Ni, the process being free from difficulties caused by less improved hot workability of such high alloys.

A still further object of the present invention is to provide a powder metallurgical process for manufacturing a sintered stainless steel product, the resistance to SCC as well as the toughness of which have markedly been improved.

SUMMARY OF THE INVENTION

As mentioned before, a conventional ferrite-austenite duplex stainless steel containing 22–25% by weight of Cr exhibits poor resistance to general corrosion, pitting corrosion, and SCC even in a $CO_2$-$Cl^-$ environment containing a minor amount of $H_2S$. Therefore, in a $CO_2$-$H_2S$-$Cl^-$ environment having a partial pressure of hydrogen sulfide of 0.1 atm or higher, an expensive, austenitic high alloy steel containing a relatively large amount of Ni, Mo, W, etc. has been used.

The inventors of the present invention have tried to improve the corrosion resistance of duplex stainless steel. Since degradation in corrosion resistance of ferrite-austenite duplex steel is caused by a preferential åttack to a ferritic phase and even a high Cr-, high Mo-, ferritic stainless steel does not exhibit satisfactory corrosion resistance in a $CO_2$-$H_2S$-$Cl^-$ environment, we concluded that degradation in corrosion resistance is inevitable in a ferrite-austenite duplex phase stainless steel.

On the other hand, the inventors have carried out extensive study of the effect of Cr, Ni, and Mo on the corrosion resistance of an austenitic high alloy steel in an oil well environment containing a large amount of $CO_2$ gas, $H_2S$ gas, and $Cl^-$ ions.

FIG. 4 through FIG. 6 are graphs which one of the inventors presented at a meeting named "NACE CORROSION '83". These graphs were obtained by plotting data showing an influence of Cr, Ni, and Mo addition as well as $P_{H2S}$ on the corrosion resistance at 250° C. under conditions including 20% NaCl+0.5% $CH_3COOH$ and 1.0 $MPa_{CO2}$ with varying $P_{H2S}$. On the basis of the test results we found that a satisfactory level of corrosion resistance would be ensured by the incorporation of 20% by weight or more of Cr, 20% by weight or more of Ni, and 3% by weight or more of Mo, regardless of $P_{H2S}$.

Thereafter, the inventors also found that in case of an austenitic stainless steel there is a distinct correlation between the Cr and Ni content and the resistance to SCC, which is determined by the temperature, as shown in FIG. 7. In FIG. 7 the hatched area represents the region in which the steel can exhibit satisfactory resistance against SCC under conditions of 20%NaCl, 0.5% $CH_3COOH$, 1.0 $MPa_{H2S}$, and 1.0 $MPa_{CO2}$.

Thus, on the basis of these findings the inventors made several types of new austenitic high alloys which are to be prepared through a conventional ingot-making process. However, as stated before, since duplex stainless steel may improve the threshold stress against SCC due to its keying effect, we have tried to develop a less expensive austenitic or austenite-ferrite stainless steel.

After extensive study the inventors found that a sintered product which is manufactured as follows exhibits markedly improved resistance to corrosion; at least two different types of powders of an austenitic stainless steel or powders of a ferritic-austenitic duplex stainless steel and austenitic stainless steel are prepared and combined together at a predetermined ratio to provide a compacted body which is then subjected to a sintering process.

According to the process mentioned above, it is possible to utilize a keying effect due to the presence of a discrete dispersed phase of a metallurgical austenitic structure.

Thus, the present invention is a sintered stainless steel exhibiting markedly improved resistance to stress corrosion cracking, which comprises a matrix phase and a dispersed phase, the dispersed phase of a metallurgical austenitic structure being dispersed throughout the matrix phase.

The matrix phase may be comprised of a metallurgical austenitic structure having a different alloy composition from that of the dispersed phase. Alternatively, the matrix phase may be comprised of a metallurgical austenite-ferrite duplex structure.

Thus, according to the present invention, the metallurgical structure of the sintered stainless steel comprised of the dispersed phase and the matrix phase may be an austenite+ austenite or an austenite+ duplex structure. Since a powder metallurgical process is applied, the areas of dispersed phase are discrete or isolated from each other. The SCC which occurs in the dispersed phase would be stopped at the matrix phase if it is resistant to SCC. The SCC which occurs in the matrix would be stopped at the dispersed phase if the dispersed phase is resistant to SCC or the dispersed phase is large enough to prevent the SCC from detouring it.

In this specification the matrix phase in general may be defined as being a continuous phase comprised of fine particles sintered through a powder metallurgical process. On the other hand, the dispersed phase may be defined as a discrete phase surrounded by the matrix phase. Preferably the amount of the dispersed phase is 10–90% by weight, and more preferably 20–80% by weight. The size of the dispersed phase usually corresponds to the starting particle size and is preferably large enough to prevent SCC, if it occurs, from detouring it, namely 50–250 μm.

In another aspect, the present invention is a process for manufacturing a sintered stainless steel exhibiting markedly improved resistance to stress corrosion cracking, which comprises the steps of:

preparing at least two different types of powders of austenitic stainless steel having steel compositions different from each other, or powders of austenitic stainless steel and ferrite-austenite duplex stainless steel;

combining at least these two types of austenitic stainless steel powders or powders of austenitic stainless steel and ferrite-austenite duplex stainless steel in a predetermined ratio;

mixing these at least two types of stainless steel powders; and compacting and sintering the resulting powder mixture to form a sintered stainless steel.

The compacting and sintering may be carried out by hot extrusion or by hot isostatic pressing. Alternatively, the compacting may be carried out by cold isostatic pressing. Optimum operating conditions for hot extrusion, hot isostatic pressing, and cold isostatic pressing may be determined depending on the specific steel composition of the powder. They are determined such that compacting and crystallization of the powder take place thoroughly. In case of hot isostatic pressing, the lower the processing temperature the better so long as the above conditions are satisfied.

In a still another aspect, the present invention resides in an oil well tubing and casing pipe made of the above-described sintered stainless steel.

DETAILED DESCRIPTION OF THE PREFERRED EMBODIMENTS

Figure 1:
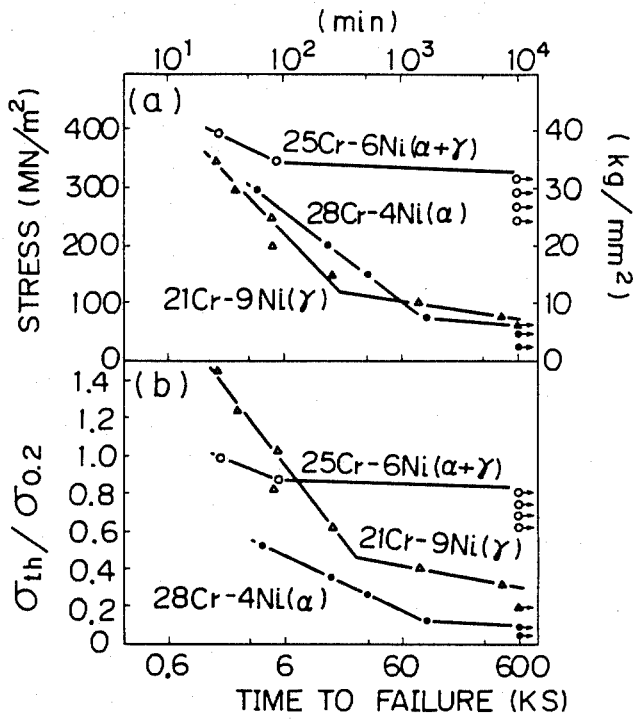
FIG. 1 shows graphs of the SCC resistance test results of conventional duplex stainless steel, austenitic stainless steel, and feritic stainless steel, all of which were prepared by an ingot making process.

According to one embodiment of the present invention, a sintered stainless steel is provided which comprises a matrix phase and a dispersed phase, both of which are of an austenitic structure. The nickel content of the matrix phase and/or dispersed phase is preferably 20% by weight or more. Preferably, the chromium content of the matrix phase and/or dispersed phase is 20% by weight or more, the nickel content is 20% by weight or more and not more than 60% by weight, and the molybdenum content is 3.0% by weight or more. Furthermore, the nitrogen content of the matrix phase and/or dispersed phase may be 0.02% by weight or more.

Namely, according to a preferred embodiment of the invention, the matrix phase and/or dispersed phase comprises:

Cr: not less than 20% by weight;
Ni: 20–60% by weight; and
Mo: not less than 3.0% by weight.

For the purpose of achieving the keying effect of at least one of the matrix phase and the dispersed phase, the matrix phase or dispersed phase has to be SCC resistant under service conditions. Therefore, in case two types of austenitic stainless steel powder are used, either one preferably contains nickel in an amount of 20% by weight or more. This is because when the nickel content is less than 20% by weight, SCC might occur depending on service conditions. For the same reason, the chromium content is preferably 20% by weight or more, and the molybdenum content is preferably 3.0% by weight or more. Since nitrogen is an austenite-former, nitrogen is optionally added in an amount of 0.02% by weight or more.

Furthermore, in case a duplex stainless steel powder is combined as a matrix phase, the steel composition of the matrix phase preferably comprises:

Cr: 20.0–30.0% by weight;
Ni: 4.0–12.0% by weight; and
Mo: 2.0–5.0% by weight.

When the Cr content is less than 20.0% by weight, the resistance to general corrosion and SCC is deteriorated. When the Cr content is over 30.0% by weight, σ (sigma) phase easily forms, causing deterioration in hot workability and corrosion resistance. In order to secure a satisfactory degree of corrosion resistance in a $CO_2$-$H_2S$-$Cl^-$ environment, the addition of Cr in an amount of 20% by weight or more is preferable. Thus, the Cr content is preferably defined as 20.0–30.0% by weight.

When the Cr content is 20.0–30.0% by weight, at least 4.0% by weight of Ni is necessary so as to secure the formation of duplex phases. However, the addition of Ni in an amount of more than 12.0% by weight is in excess.

In order to secure a satisfactory level of corrosion resistance, molybdenum in an amount of 2.0% by weight or more is desirable. The addition of molybdenum in an amount of more than 5.0% by weight markedly accelerates the formation of σ (sigma) phase.

Nitrogen is an important austenite-former and is effective to accelerate the precipitation of an austenitic phase at high temperatures. Optionally, nitrogen in an amount of not more than 0.30% may be incorporated.

In this case, too, the alloy composition of the dispersed phase preferably comprises:

Cr: not less than 20.0% by weight;
Ni: 20.0–60.0% by weight; and
Mo: not less than 3.0% by weight.

According to another preferred embodiment of the present invention, at least two types of powders of austenitic stainless steel having alloy compositions different from each other may be combined, at least one powder comprising 20.0% by weight or more of Ni. Alternatively, at least one austenitic stainless powder comprising 20.0% by weight or more of Cr, 20–60% by weight of Ni, and 3.0% by weight or more of Mo may be combined. Optionally, nitrogen may be incorporated in an amount of 0.02% by weight or more.

When a duplex stainless steel powder is combined, the alloy composition of the duplex steel preferably comprises 20.0–30.0% by weight of Cr, 4.0–12.0% by weight of Ni, and 2.0–5.0% by weight of Mo. In this case, too, an austenitic stainless steel powder serving as a dispersed phase may comprise 20.0% by weight or more of Cr, 20–60% by weight of Ni, and 3.0% by weight or more of Mo. Optionally, nitrogen may be incorporated in an amount of 0.02% by weight or more.

The specific steel composition of stainless steel powders to be combined as a matrix phase and dispersed phase may be freely selected within the above ranges taking into consideration the application of the resulting sintered steel.

It is believed that when an austenitic stainless steel powder is combined as a dispersed phase in an amount of not less than 10% by weight, its keying effect can be expected even if SCC occurs in a matrix phase. Preferably, the matrix phase powder and the dispersed phase powder are combined in equal amounts.

As already mentioned, according to the present invention the propagation of SCC is stopped by the presence of a dispersed phase exhibiting improved resistance to SCC. In addition, when the matrix phase exhibits more improved resistance to corrosion than the dispersed phase, then the propagation of SCC, even if it occurs in the dispersed phase, will be stopped by the matrix phase.

Figure 8:
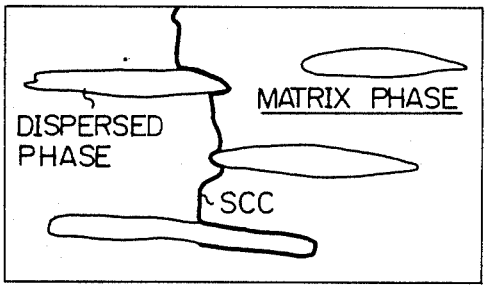
FIGS. 8 through 10 are views schematically illustrating the propagation of SCC in a sintered stainless steel of the present invention.
Figure 9:
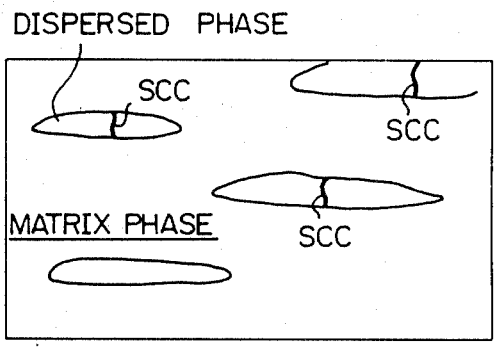

FIGS. 8 and 9 shows the mechanisms mentioned above.

FIG. 8 shows the case in which the resistance to corrosion of the dispersed phase is superior to that of the matrix phase, and the propagation of SCC indicated by a thick line goes through the matrix phase, detours the dispersed phase, and goes on through the matrix phase. The SCC cannot go through the dispersed phase. However when the dispersed phase is large, the SCC cannot detour but stops upon reaching the large dispersed phase.

On the other hand, as shown in FIG. 9 in which the corrosion resistance of the matrix phase is superior to that of the dispersed phase, the propagation of SCC is stopped at the matrix phase as shown by a thick line.

Figure 2:
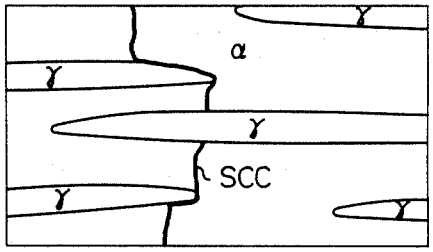
FIG. 2 is a view schematically illustrating the propagation of SCC in a conventional stainless steel.
Figure 3:
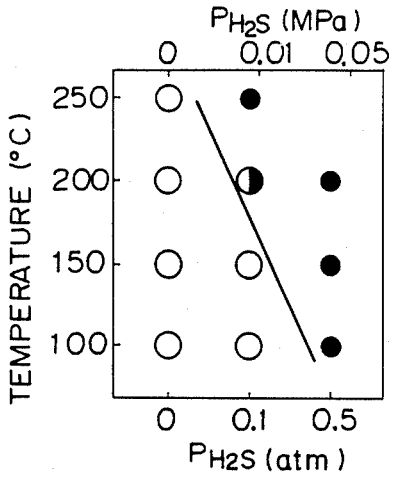
FIG. 3 is a graph showing the SCC resistance of a conventional ferrite-austenite duplex stainless steel.
Figure 4:
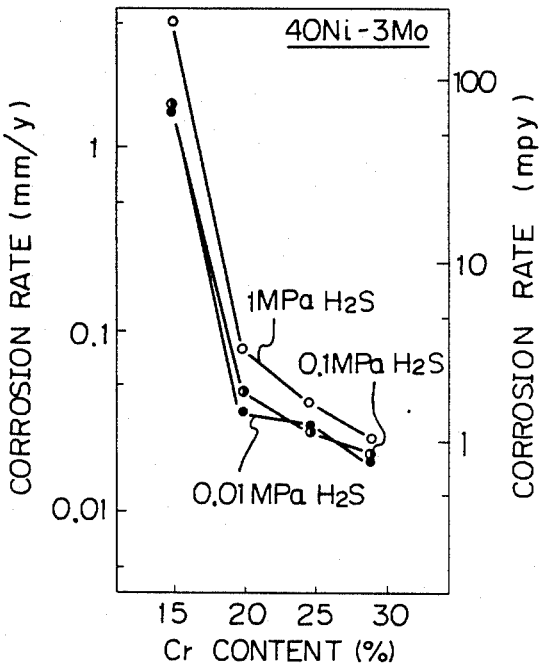
FIGS. 4 through 6 are graphs showing the relationship between the contents of Cr(%), Ni(%) and Mo(%) and the SCC resistance of a conventional stainless steel, respectively.
Figure 5:
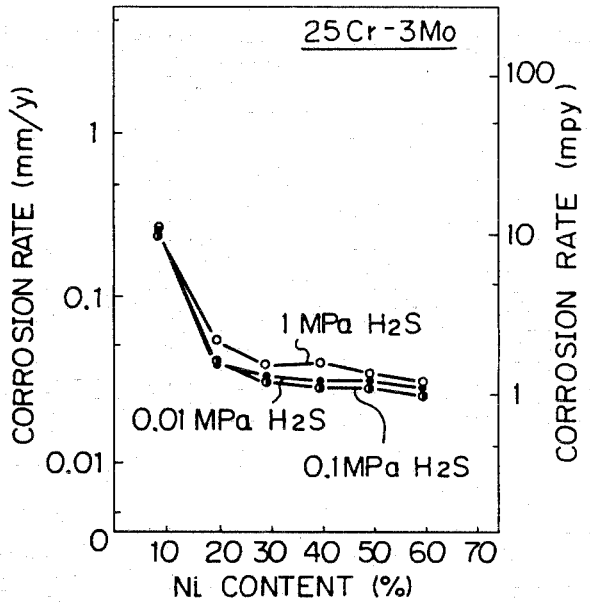
Figure 6:
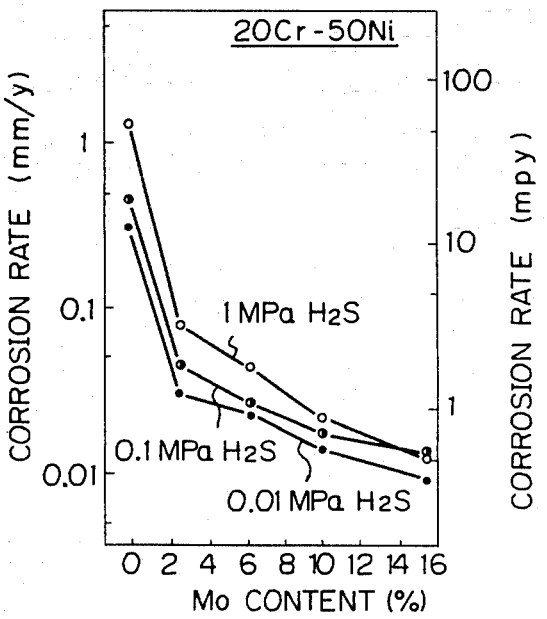
Figure 7:
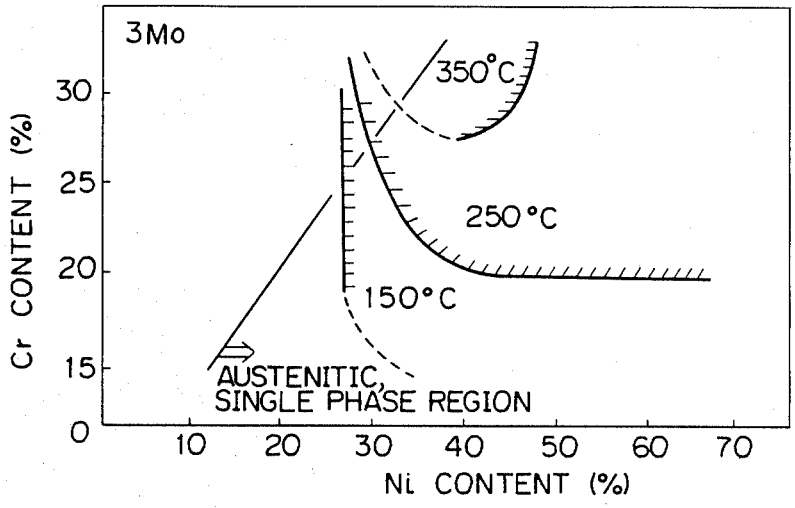
FIG. 7 is a graph showing the influence of the contents of Cr(%) and Ni(%) on the SCC resistance of a conventional stainless steel.
Figure 10:
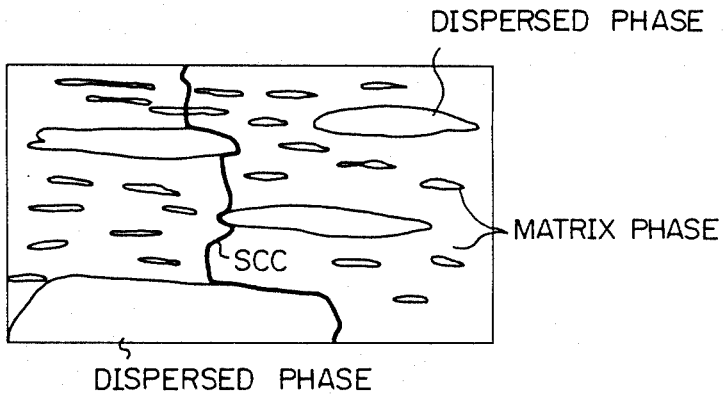

When a duplex stainless steel is used as a matrix phase, the presence of an isolated, austenitic dispersed phase brings about improvement in the threshold stress against SCC due to its keying effect. The threshold stress value is much higher than that of a duplex stainless steel having a steel composition corresponding to that of the matrix phase. In addition, since according to the present invention, an austenitic dispersed phase which exhibits improved resistance to SCC is dispersed in an isolated, discrete state, even if the SCC propagates through the matrix phase, it has to detour the dispersed phase and the propagation of SCC will be stopped by the presence of the dispersed phase. The manner in which the SCC propagates and stops is shown in FIG. 10. Compare FIG. 10 with FIG. 2 which shows the propagation of SCC in a conventional stainless steel.

As mentioned before, according to the present invention, the hot workability of a stainless steel is improved. The higher the content of Ni, Cr, and Mo, the more the corrosion resistance is improved, and the more the hot workability is deteriorated. However, according to the present invention, even when at least two types of steel powders with poor hot workability in general are combined, either one which is superior to others to any extent in respect to hot workability may serve as a lubricating agent, resulting in improvement to some extent in hot workability of the mixture of the powders.

Thus, according to the present invention, sintered stainless steel which exhibits markedly improved resistance to SCC can be obtained.

The sintered stainless steel and the oil well tubing and casing pipe of the present invention can be formed through at least one of the following steps into a final shape, although the compacting and sintering steps are indispensible: compacting, cold isostatic pressing (CIP), sintering, hot isostatic pressing (HIP), cold extrusion, cold drawing, hot extrusion, forging, rolling, etc.

If necessary, any type of heat treatment may be applied.

In other words, the sintered stainless steel of the present invention includes any one which has been produced through at least one of the above-mentioned working steps.

The matrix of the steel according to the present invention, in case where the matrix is composed of a single austenitic phase, may be a substantially single austenitic phase, and it may also be an austenitic phase which contains a slight amount of martensitic phase and other precipitates. The amount of the martensite phase is at most 10% by weight. In addition, not only inevitable impurities and alloying elements usually found in a stainless steels but also free-cutting additives such as S, Pb, Se, Te, Ca, etc. may also be incorporated in the steel.

It is herein to be noted that the present invention is not limited to the process through which the starting powder was prepared not to any particular shape and size distribution of the starting powders so long as they do not adversely affect the purpose of the present invention. In addition, alminum may be added as an alloying element.

The present invention will be further described in conjunction with some working examples, which are presented merely for illustrative purposes.

EXAMPLE 1

Five types of stainless steel powders (−300 mesh) the alloy composition of which are shown in Table 1 where prepared through an atomization process. The steel compositions of Steel Powders A, B, C, and D correspond to austenitic stainless steel;s, Steel Powder E corresponds to ferritic stainless steels, Steels F and G presented as conventional one correspond to austenitic stainless steel prepared by a conventional ingot-making process, and Steels H and I presented as conventional one correspond to duplex stainless steel prepared by a conventional ingot-making process.

These powders were combined in the proportions shown in Table 2. The resulting mixtures were placed in separate capsules made of carbon steel, and the capsules were evacuated under a vacuum of $1\times10^{-5}$ mmHg at 500° C. for one hour while being heated and then sealed.

The evacuation may be carried out at room temperature. However, in order to promote the removal of moisture, heating is desirable. The heating temperature for this purpose is preferably 500° C. or lower. The thus packed capsules were sintered for one hour at 1080° C.

at a pressure of 2000 atms using hot isostatic pressing (HIP).

The resulting sintered products were further subjected to heating at 1200° C. for one hour. After that the products were subjected to hot forging to obtain the following dimensions: 30 mm thick×60 mm wide×70 mm long.

The thus hot forged products in the form of plates were reheated to 1200° C. and were hot rolled to the final dimensions of 7 mm thick×60 mm wide. The hot rolled products were then subjected to final annealing at 1120° C. for 30 minutes and water cooled. Thereafter cold working was performed with a reduction in thickness of 40%.

Test pieces were cut from the thus produced sintered stainless steel plates and they were subjected to a room temperature tensile test, a Charpy inpact test, and a SCC resistance test.

The room temperature tensile test was carried out using a round test piece with a parallel portion 3 mm in diameter and 20 mm in length.

The Charpy impact test was carried out at −20° C. using JIS No. 4, half-sized test piece (5 mm thick) with a 2V-shaped notch.

Figure 11:
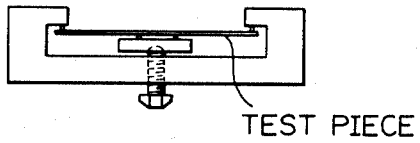
FIGS. 11 through 13 are views illustrating the shape of the test pieces used in the SCC test.
Figure 12:
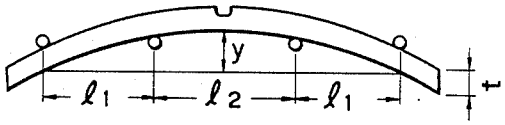

The SCC resistance test was carried out using a four-point-contacting bending test piece fixed in a T-shaped jig shown in FIG. 11. The test piece had a U-shaped notch at its lengthwise center. The dimension of the test piece was 75×10×2 mm and the size of the notch was 0.25R. The test piece was placed in a 20% NaCl+0.5%$CH_3COOH$ solution containing $H_2S$ at 10 atms and $CO_2$ at 10 atms at a pH of 2. The testing period was 2000 hours. The testing temperatures were 150° C. and 250° C. This applied stress was $1.0\times\sigma_y$. The applied stress was calculated in accordance with the equation shown in FIG. 12.

The test results are summarized in Table 2. A preferential corrosion of a ferritic phase was observed in Comparative Steel No. 4 which was manufactured from a mixture of ferrite stainless steel powder and austenitic stainless steel powder. The occurrence of SCC was also observed. Comparative Steel No. 7 which was manufactured from a single austentic stainless steel powder also suffered from SCC at both temperatures of 150° C. and 250° C.

However, the sintered steels of the present invention were free from SCC.

EXAMPLE 2

A seamless steel tube was manufactured using the stainless steel powders shown in Table 1.

The powders were mixed at a ratio shown in Table 2. The resulting mixture was packed into a capsule made of carbon steel 300 mm long (outer diameter of 200 mm and inner diameter of 60 mm). The capsule was evacuated under a vacuum of $1\times10^{-5}$ mmHg for three hours while being heated at 500° C., after which it was sealed.

After sealing the capsule, the capsule was subjected to cold isostatic pressing (CIP) under conditions including 6000 kg/cm$^2$×1 min in order to make the density of a cold compact within the capsule uniform and to obtain a low porosity. Then the capsule was heated in an electric furnace at 1250° C. and was subjected to hot extrusion to obtain a seamless tube with an outer diameter of 73 mm and a wall thickness of 7 mm. The thus obtained seamless tube was kept at 1130° C. for 40 minutes and then water cooled. Thereafter the tube was subjected to cold working with a reduction in thickness of 30%, and the resulting tube was subjected to tests.

Figure 13:
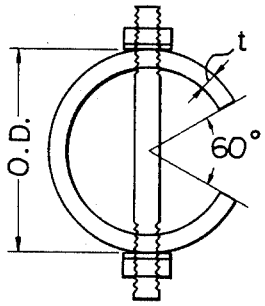

The resistance to SCC was determined under the same conditions as in Example 1 using a C-shaped ring type test piece. The C-ring test was carried out in accordance with ASTM G38-73. The test piece is shown in FIG. 13.

The test results are summarized in Table 2. The same tendency was observed as in Example 1. A preferential corrosion of a ferritic phase was observed in Comparative Steel No. 4 prepared from a mixture of ferritic stainless steel powder and austenitic stainless steel powder. The occurrence of SCC of the through type was also observed.

Comparative Steel No. 7 which was manufactured from a single austenitic stainless steel powder suffered from SCC at both 150° C. and 250° C.

However, the sintered steels of the present invention were free from SCC except Steel No. 6 at 250° C. It is herein to be noted that even Steel No. 6 was free fro SCC at 150° C.

EXAMPLE 3

Example 1 was repeated using the nine types of stainless steel powders (−300 mesh) shown in Table 3. The steel composition of Steel Powders J, K, L, M, N, and P correspond to austenitic stainless steels, Steel Powder Q corresponds to ferritic stainless steel, Steel Powders R and S correpsond to duplex stainless steels, and Steels T and U correspond to stainless steels prepared using a conventional ingot-making process.

These powders were combined in the proportions shown in Table 4. The SCC resistance test was carried out in the same manner as in Example 1 except that the test piece was placed in a 20% NaCl solution containing $H_2S$ at 0.05, 0.1, and 0.5 atm and $CO_2$ at 25 atms at a pH of 2. The testing temperature was 150° C.

The test results are summarized in Table 4.

EXAMPLE 4

Example 2 was repeated using the stainless steel powders shown in Table 3.

The test results are also summarized in Table 4.

As it apparent from the results shown in Table 4, the sintered stainless steels of the present invention were free from SCC under the indicated service conditions. It is to be noted that the SCC resistance of Steels Nos. 15 and 16 of the present invention decreased with an increase in the amount of $H_2S$, resulting in the occurrence of pitting corrosion. This is because the Cr content of the austenitic stainless steel powder employed was less than 20% by weight, and the amounts of Ni and Mo were also outside the preferred range of the present invention.

The test results of Comparative Steel No. 17 show that the empolyment of ferritic stainless steel powder is not effective to prevent the occurrence of cracking under severe corrosive conditions.

Although the invention has been described in respect to preferred embodiments it is to be understood that variations and modifications may be employed without departing from the concept of the invention as defined in the following claims.

TABLE 1

(% by weight)

| Steel Powder | Cr | Ni | Mo | C | N | S | Cu | W | Ti | Nb | O | Remarks |
|---|---|---|---|---|---|---|---|---|---|---|---|---|
| A | 21.2 | 25.7 | 4.88 | 0.04 | 0.06 | 0.001 | 0.8 | — | — | — | 0.002 | Austenitic |
| B | 21.7 | 42.3 | 3.10 | 0.01 | 0.02 | 0.001 | 2.2 | — | 0.91 | — | 0.003 | Stainless |
| C | 26.0 | 50.3 | 6.20 | 0.02 | 0.12 | 0.001 | 1.0 | 1.0 | — | — | 0.002 | Steel Powder |
| D | 21.9 | 55.3 | 9.13 | 0.02 | 0.02 | 0.001 | — | — | 0.40 | 3.60 | 0.002 | |
| E | 26.2 | 0.4 | 1.02 | 0.01 | 0.01 | 0.001 | — | — | — | — | 0.003 | Ferritic Stainless Steel Powder |
| F | 20.6 | 35.7 | 4.28 | 0.01 | 0.02 | 0.001 | 0.7 | — | — | — | 0.003 | Conventional |
| G | 21.7 | 42.0 | 3.00 | 0.01 | 0.02 | 0.001 | 2.2 | — | 0.92 | — | 0.006 | Austenitic Stainless Steel |
| H | 22.5 | 5.5 | 3.0 | 0.02 | 0.13 | 0.001 | 0.4 | — | — | — | 0.003 | Conventional |
| I | 25.0 | 7.0 | 3.0 | 0.02 | 0.15 | 0.001 | 0.5 | 0.3 | — | — | 0.004 | Duplex Stainless Steel |

TABLE 2

| Steel No. | Mixing Ratio of Steel Powders (% by weight) A | B | C | D | E | Tensile Properties at Room Temp. (40% Cold Worked) Proof Strength (kgf/mm²) | Tensile Strength (kgf/mm²) | Elongation (%) | Drawing Ratio (%) | Charpy Impact Strength (kg-m/cm²) |
|---|---|---|---|---|---|---|---|---|---|---|
| 1 | 50 | 50 | — | — | — | 103.5 | 121.6 | 13.7 | 23.6 | 18.7 |
| 2 | 50 | — | 50 | — | — | 102.4 | 118.2 | 11.3 | 28.2 | 20.5 |
| 3 | 50 | — | — | 50 | — | 118.2 | 140.6 | 14.8 | 19.6 | 17.2 |
| 4 | 50 | — | — | — | 50 | 83.6 | 95.7 | 10.6 | 26.1 | 2.6 |
| 5 | 30 | — | 70 | — | — | 104.1 | 113.3 | 10.3 | 28.6 | 15.3 |
| 6 | 70 | — | 30 | — | — | 108.7 | 123.4 | 10.1 | 24.7 | 17.2 |
| 7 | 100 | — | — | — | — | 117.0 | 133.1 | 6.8 | 25.7 | 18.2 |
| F | Manufactured using an ingot-making process | | | | | 90.6 | 98.3 | 12.6 | 23.3 | 22.7 |
| G | | | | | | 91.7 | 108.3 | 14.5 | 23.6 | 21.0 |
| H | | | | | | 110.9 | 124.7 | 11.7 | 47.2 | 25.0 |
| I | | | | | | 116.4 | 125.1 | 12.5 | 46.0 | 24.3 |

| Steel No. | 20% NaCl + 0.5% $CH_3COOH$, 10 atm $H_2S$ + 10 atm $CO_2$, 150° C., 2000 hr: Four Point Contacting Bending Test (1.0 σ y) | C-Ring Test | 20% NaCl + 0.5% $CH_3COOH$, 10 atm $H_2S$ + 10 atm $CO_2$, 250° C., 2000 hr: Four Point Contacting Bending Test (1.0 σ y) | C-Ring Test | Remarks |
|---|---|---|---|---|---|
| 1 | No SCC | No SCC | No SCC | No SCC | Invention |
| 2 | " | " | " | " | |
| 3 | " | " | " | " | |
| 4 | SCC | SCC | SCC | SCC | Comparative |
| 5 | No SCC | No SCC | No SCC | No SCC | Invention |
| 6 | " | " | " | SCC | |
| 7 | SCC | SCC | SCC | SCC | Convention |
| F | No SCC | No SCC | " | " | |
| G | " | " | " | " | |
| H | SCC | SCC | " | " | |
| I | " | " | " | " | |

TABLE 3

(% by weight)

| Steel Powder | Cr | Ni | Mo | C | N | S | Cu | W | Ti | Nb | O | Remarks |
|---|---|---|---|---|---|---|---|---|---|---|---|---|
| J | 22.0 | 29.3 | 3.20 | 0.10 | 0.12 | 0.001 | 0.80 | — | — | — | 0.002 | Austenitic |
| K | 20.3 | 35.6 | 5.29 | 0.01 | 0.12 | 0.001 | 0.77 | — | — | — | 0.002 | Stainless |
| L | 25.1 | 34.2 | 3.15 | 0.01 | 0.02 | 0.001 | 0.69 | — | — | 0.42 | 0.002 | Steel Powder |
| M | 24.0 | 48.4 | 6.20 | 0.01 | 0.02 | 0.001 | 0.30 | — | — | — | 0.002 | |
| N | 18.8 | 13.0 | 3.01 | 0.01 | 0.02 | 0.001 | 0.25 | — | — | — | 0.004 | |
| P | 14.1 | 25.0 | 2.50 | 0.02 | 0.02 | 0.001 | 0.91 | — | 1.54 | — | 0.003 | |
| Q | 26.2 | 0.4 | 1.02 | 0.01 | 0.01 | 0.001 | — | — | — | — | 0.002 | Ferritic Stainless Steel Powder |
| R | 22.7 | 5.8 | 2.92 | 0.02 | 0.13 | 0.001 | 0.50 | — | — | — | 0.003 | Duplex |
| S | 25.8 | 6.9 | 3.03 | 0.02 | 0.14 | 0.001 | 0.45 | 0.3 | — | — | 0.003 | Stainless Steel Powder |
| T | 22.5 | 5.5 | 3.03 | 0.02 | 0.13 | 0.001 | 0.42 | — | — | — | 0.003 | Conventional |
| U | 25.5 | 7.2 | 3.10 | 0.02 | 0.13 | 0.001 | 0.30 | 1.3 | — | — | 0.003 | " |

TABLE 4

| Steel No. | Mixing Ratio of Steel Powders (% by weight) J | K | L | M | N | P | Q | R | S | Tensile properties at Room Temp. (40% Cold Worked) Proof Strength (kgf/mm²) | Tensile Strength (kgf/mm²) | Elongation (%) | Drawing Ratio (%) | Charpy Impact Strength (kg-m/cm²) |
|---|---|---|---|---|---|---|---|---|---|---|---|---|---|---|
| 11 | 40 | — | — | — | — | — | — | 60 | — | 91.7 | 102.6 | 12.8 | 46.1 | 19.2 |
| 12 | — | 50 | — | — | — | — | — | 50 | — | 93.7 | 104.5 | 12.6 | 57.0 | 18.8 |
| 13 | — | — | 40 | — | — | — | — | — | 60 | 93.8 | 104.2 | 13.0 | 38.3 | 17.9 |
| 14 | — | — | — | 50 | — | — | — | — | 50 | 99.0 | 105.9 | 11.5 | 38.9 | 18.8 |
| 15 | — | — | — | — | 40 | — | — | — | 60 | 86.8 | 94.8 | 18.2 | 63.0 | 20.1 |
| 16 | — | — | — | — | — | 40 | — | — | 60 | 87.9 | 92.3 | 11.0 | 51.0 | 17.8 |
| 17 | — | — | — | — | — | — | 40 | — | 60 | 77.4 | 81.2 | 28.3 | 60.0 | 2.3 |
| 18 | — | — | — | — | — | — | — | 100 | — | 88.7 | 100.4 | 12.2 | 53.3 | 18.8 |
| 19 | — | — | — | — | — | — | — | — | 100 | 90.1 | 99.8 | 11.2 | 53.6 | 19.0 |
| T | Manufactured using an ingot-making process | | | | | | | | | 110.9 | 124.7 | 11.5 | 47.1 | 24.3 |
| U | | | | | | | | | | 115.8 | 124.3 | 12.6 | 46.0 | 23.8 |

| Steel No. | 20% NaCl, 0.05 atm $H_2S$ + 25 atm $CO_2$, 150° C., 2000 hr: Four Point contacting Bending Test (1.0 σ y) | C-Ring Test | 20% NaCl, 0.1 atm $H_2S$ + 25 atm $CO_2$, 150° C., 2000 hr: Four Point Contacting Bending Test (1.0 σ y) | C-Ring Test | 20% NaCl, 0.5 atm, $H_2S$ + 25 atm $CO_2$, 150° C., 2000 hr: Four Point Contacting Bending Test (1.0 σ y) | C-Ring Test | Remarks |
|---|---|---|---|---|---|---|---|
| 11 | No SCC | No SCC | No SCC | No SCC | No SCC | No SCC | Invention |
| 12 | " | " | " | " | " | " | |
| 13 | " | " | " | " | " | " | |
| 14 | " | " | " | " | " | " | |
| 15 | " | " | SCC | SCC | SCC* | SCC* | |
| 16 | " | " | No SCC | " | SCC | SCC | |
| 17 | No SCC | No SCC | Cracking* | Cracking* | Cracking* | Cracking* | Conventional |
| 18 | SCC | SCC | SCC | SCC | SCC | SCC | |
| 19 | " | " | " | " | " | " | |
| T | " | " | " | " | " | " | |
| U | " | " | " | " | " | " | |

Note: *Preferential Corrosion of ferrite phase and pitting corrosion were observed.

What is claimed is:

1. A sintered stainless steel exhibiting improved resistance to stress corrosion cracking, which comprises a matrix phase and a dispersed phase, said dispersed phase being dispersed in said matrix phase and comprised of an austenitic metallurgical structure derived from a starting powder of austenitic steel, and said matrix phase being comprised of an austenitic metallurgical structure derived from a starting powder of another austenitic stainless steel having a composition different from that of the austenitic metallurgical structure of said dispersed phase and in which either said matrix phase, said dispersed phase or both said phases comprises:

Cr: not less than 20%;

Ni: 20–60% by weight; and

Mo: not less than 3.0% by weight.

2. A sintered stainless steel as defined in claim 1, in which either said matrix phase, said dispersed phase or both said phases comprises nitrogen in an amount of 0.02% by weight or more.

3. A sintered stainless steel exhibiting improved resistance to stress corrosion cracking, which comprises a matrix phase and a dispersed phase, said dispersed phase being dispersed in said matrix phase and comprised of an austenitic metallurgical structure derived from a starting powder of austenitic stainless steel, and said matrix phase being comprised of a ferritic-austenitic duplex metallurgical structure derived from a starting powder of dual-phase stainless steel further in which the dispersed phase comprises:

Cr: not less than 20.0% by weight;

Ni: 20.0–60.0% by weight; and

Mo: not less than 3.0% by weight.

4. A sintered stainless steel as defined in claim 3, in which the matrix phase comprises:

Cr: 20.0–30.0% by weight;

Ni: 4.0–12.0% by weight; and

Mo: 2.0–5.0% by weight.

5. A sintered stainless steel as defined i n claim 4, in which the matrix phase further comprises nitrogen in an amount of 0.30% or less.

6. A sintered stainless steel as defined in claim 3, in which the dispersed phase further comprises nitrogen in an amount of 0.02% by weight or more.

* * * * *